US008027503B2

(12) United States Patent
Konuma et al.

(10) Patent No.: US 8,027,503 B2
(45) Date of Patent: Sep. 27, 2011

(54) DIAPHRAGM FOR SPEAKER DEVICE, SPEAKER DEVICE AND MOBILE PHONE

(75) Inventors: Shinsuke Konuma, Yamagata (JP); Akihiko Furuto, Yamagata (JP); Kunio Mitobe, Yamagata (JP)

(73) Assignees: Pioneer Corporation, Tokyo (JP); Tohoku Pioneer Corporation, Tendo-shi (JP)

( * ) Notice: Subject to any disclaimer, the term of this patent is extended or adjusted under 35 U.S.C. 154(b) by 1288 days.

(21) Appl. No.: 11/641,116

(22) Filed: Dec. 19, 2006

(65) Prior Publication Data

US 2007/0140520 A1 Jun. 21, 2007

(30) Foreign Application Priority Data

Dec. 21, 2005 (JP) ..... 2005-368540

(51) Int. Cl.
*H04R 1/00* (2006.01)
*H04R 7/00* (2006.01)

(52) U.S. Cl. ..... 381/400; 381/398; 381/401; 381/408; 381/409; 381/423; 181/171

(58) Field of Classification Search ..... 381/400, 381/430, 412, 419; 181/171
See application file for complete search history.

(56) References Cited

U.S. PATENT DOCUMENTS 5,892,185 A * 4/1999 Takahashi et al. ..... 181/171
2003/0164262 A1 * 9/2003 Ito et al. ..... 181/171

FOREIGN PATENT DOCUMENTS

JP 5-30592 2/1993
JP 11-187484 7/1999

* cited by examiner

*Primary Examiner* — Curtis Kuntz
*Assistant Examiner* — Sunita Joshi
(74) *Attorney, Agent, or Firm* — Nixon & Vanderhye, P.C.

(57) ABSTRACT

A diaphragm of a speaker device, formed into an elongated configuration, has a recessed shape and includes a voice coil arrangement part extending in its longitude direction. The voice coil arrangement part has a gap with a constant width in its lateral direction and includes a voice coil supporting part for supporting a voice coil and an expanded part provided at a position along it.

10 Claims, 10 Drawing Sheets

DIAPHRAGM FOR SPEAKER DEVICE, SPEAKER DEVICE AND MOBILE PHONE

BACKGROUND OF THE INVENTION

1. Field of the Invention

The present invention relates to a configuration of a diaphragm for a speaker device preferably usable for a mobile phone.

2. Description of Related Art

Conventionally, there is known a dome-shaped speaker including a dome-shaped diaphragm having a voice coil form having a U-shaped cross-section (see Japanese Patent Application Laid-open under No. 5-30592 (p. 5, FIG. 6), which is referred to as "Reference-1" hereinafter).

In the dome-shaped speaker disclosed in Reference-1, since the voice coil is arranged in the voice coil form having the U-shaped cross-section, the driving force of the voice coil directly operates on the voice coil form at the time of sound reproduction. Therefore, the strength capable of enduring the driving force of the voice coil is necessary for the voice coil form. In this point, since the voice coil form is formed into a circular or track shape and an annular shape, it can be said that the strength is comparatively ensured in the voice coil form in consideration of the configuration.

Meanwhile, there is known a speaker formed into an elongated shape in comparison with the dome-shaped speaker (see Japanese Patent Application Laid-open under No. 11-187484, which is referred to as "Reference-2" hereinafter).

In the speaker according to Reference-2, the voice coil is formed into a flat-plate shape, and a central part of the diaphragm having a recessed cross-section is connected to an upper coil being a component of the voice coil. Thereby, at the time of sound reproduction, the driving force of the voice coil is transmitted to the diaphragm itself via the central part of the diaphragm.

However, in the speaker device according to Reference-2, since the central part of the diaphragm has the elongated configuration to be formed into a linear shape, the strength of the part is structurally smaller than that of the circular voice coil form of the diaphragm disclosed in Reference-1. Thus, at the time of the sound reproduction, the central part of the diaphragm is bent, or the central part of the diaphragm rolls. Then, it may happen that, in the magnetic gap, the central part of the diaphragm and the magnetic circuit contact or collide and an abnormal sound occurs.

In this point, in the speaker device, a damper is provided at a position on a side opposite to the diaphragm with sandwiching the voice coil, and the central part of the damper is connected to a lower part coil of the voice coil. Thereby, the strength of the supporting part of the voice coil is ensured to some extent, and such a problem hardly happens. Namely, in the speaker having the elongated configuration, the strength of the supporting part of the voice coil is ensured to some extent by providing the damper, and the above problem hardly happens.

SUMMARY OF THE INVENTION

The present invention has been achieved in order to solve the above problem. It is an object of this invention to provide a diaphragm for a speaker device and a speaker device employing the diaphragm, having an elongated configuration capable of reducing rolling without providing a damper.

According to one aspect of the present invention, there is provided a diaphragm for a speaker device including a voice coil arrangement part having a recessed shape and extending in one direction, wherein the voice coil arrangement part includes: a voice coil supporting part, having a first gap with a constant width in a direction substantially orthogonal with respect to the one direction, for supporting the voice coil; and an expanded part provided along the voice coil supporting part and having a second gap with a width larger than that of the first gap.

Thereby, as compared with the voice coil arrangement part according to a comparative example, having an elongated configuration and formed in a linear shape, the strength of the voice coil arrangement part can be increased. Thus, if the diaphragm for the speaker device is applied to the speaker device, it becomes unnecessary to provide a damper in order to reinforce the strength of the vibration system. In addition, it can be reduced that the voice coil arrangement part is bent, warped or rolls at the time of the sound reproduction. Therefore, it can be prevented that the voice coil arrangement part and the magnetic circuit contact or collide. Thereby, occurrence of an abnormal sound can be prevented.

In a preferred example, the expanded part may be provided in an extending direction of the voice coil arrangement part with a constant space. In addition, the expanded parts may be provided at positions near both ends in an extending direction of the voice coil arrangement part and at a substantially central position, respectively. Thereby, the strength of the entire voice coil arrangement part can be enhanced.

Additionally, in the diaphragm for the speaker device, as a result of sufficiently ensuring of the strength of the voice coil arrangement part, as described above, the width of the gap of the voice coil supporting part at which the voice coil is arranged can be set to as narrow a value as possible, e.g., substantially 0.2mm, the magnetic flux density in the magnetic gap can be enhanced, and the speaker device with high sensitivity and high efficiency can be obtained. Thus, it can be preferably used as a speaker for a mobile phone for which requirement of the high sensitivity and the high efficiency becomes recently high, or as a micro speaker for various kinds of electronic equipments.

At the time of manufacturing of the diaphragm for the speaker device, an effect described below can be obtained.

The diaphragm for the speaker device is manufactured by clamping (pressing) a base material with using a diaphragm forming die having a negative die and a positive die.

Therefore, in accordance with the shape of the diaphragm for the speaker device, the positive die has a projecting part having a rectangular parallelepiped shape for forming the voice coil supporting part, and a cylindrical projecting part provided at a position along the projecting part and having a cylindrical shape for forming the expanded part. The negative die has a recessed part having a gap formed into a rectangular parallelepiped shape for forming the voice coil supporting part with the projecting part of the positive die, and a cylindrical projecting part provided at a position along the recessed part and having a cylindrical gap for forming the expanded part with the cylindrical projecting part of the positive die. Since the projecting part and the recessed part are parts functioning to form the voice coil supporting part having the width of substantially 0.2 mm, preferably as the speaker device for the mobile phone, the width of the projecting part is set to a value smaller than substantially 0.2 mm, and the width of the gap of the recessed part is set to a value larger than substantially 0.2 mm, for example. In addition, the width of the cylindrical projecting part is set larger than the width of the projecting part, and the width passing through the center of the cylindrical projecting part is set to the maximum width. Meanwhile the width of the cylindrical recessed part is set larger than the width of the gap of the recessed part. The width passing through the center of the cylindrical recessed part is set to the maximum width.

In this manner, in the diaphragm forming die, since the positive die has not only the projecting part having the rectangular parallelepiped shape but also the cylindrical projecting part having the cylindrical shape, the strength of the projecting part and the cylindrical projecting part for forming the voice coil arrangement part can be particularly improved, and the projecting part and the cylindrical projecting part are hardly deformed even when the pressure is applied to the parts at the time of press. Thus, it can be prevented that the diaphragm forming die is damaged and forming of the diaphragm for the speaker device fails. Thereby, as a side effect, at the time of manufacturing of the diaphragm forming die, forming of the projecting part and the cylindrical projecting part of the positive die never fails, and the diaphragm forming die including the part can be easily manufactured. In addition, as the strength of the projecting part and the cylindrical projecting part of the positive die of the diaphragm forming die is improved, the endurance life becomes long, and the life of the diaphragm forming die can be long.

In a manner of the above speaker device, the gap of the voice coil supporting part may form a space in a rectangular parallelepiped shape, and the gap of the expanded part may form a space in a prismatic or cylindrical shape. Thereby, the width of the gap of the expanded part can be larger than the width of the gap of the voice coil supporting part, and the strength of the voice coil arrangement part can be improved.

In another manner of the above speaker device, the voice coil arrangement part may have a substantially U-shaped cross-section and may be formed into an elongated shape in the one direction. In addition, the voice coil arrangement part may be provided at a substantially central position in a lateral direction of the diaphragm for the speaker device.

In still another aspect of the above speaker device, the voice coil may be arranged at the voice coil arrangement part, and the voice coil supporting part may sandwich and fix the voice coil. Thereby, the voice coil can be stably retained without being bent.

In still another aspect of the above speaker device, a sound output part having a hemisphere cross-section and having a function to output an acoustic wave may be provided on an outer side of the voice coil arrangement part. Thereby, the acoustic wave can be outputted via the sound output part.

According to another aspect of the present invention, there is provided a speaker device including the above diaphragm for the speaker device. For example, in a manner, the above speaker device may further include a magnetic circuit including a magnetic gap. The magnetic gap may be provided at a substantially central position of the magnetic circuit, and the voice coil arrangement part of the diaphragm for the speaker device may be arranged in the magnetic gap. Thereby, the speaker device can be thin and slim.

According to still another aspect of the present invention, there is provided a mobile phone including the above speaker device. Thereby, the speaker device capable of reducing rolling can be formed.

The nature, utility, and further features of this invention will be more clearly apparent from the following detailed description with respect to preferred embodiment of the invention when read in conjunction with the accompanying drawings briefly described below.

DETAILED DESCRIPTION OF THE PREFERRED EMBODIMENT

Now, a preferred embodiment of the present invention will be described below with reference to the attached drawings.

[Configuration of Speaker Device]

Figure 1:
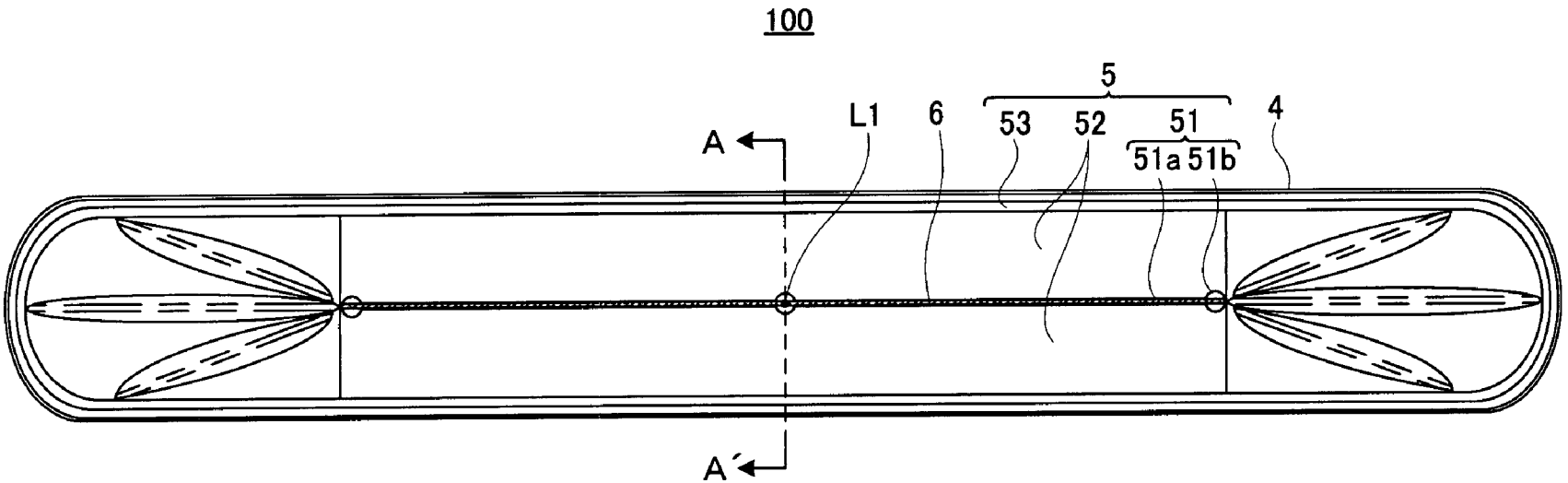
FIG. 1 is a plane view showing a configuration of a speaker device according to an embodiment of the present invention.
Figure 2:
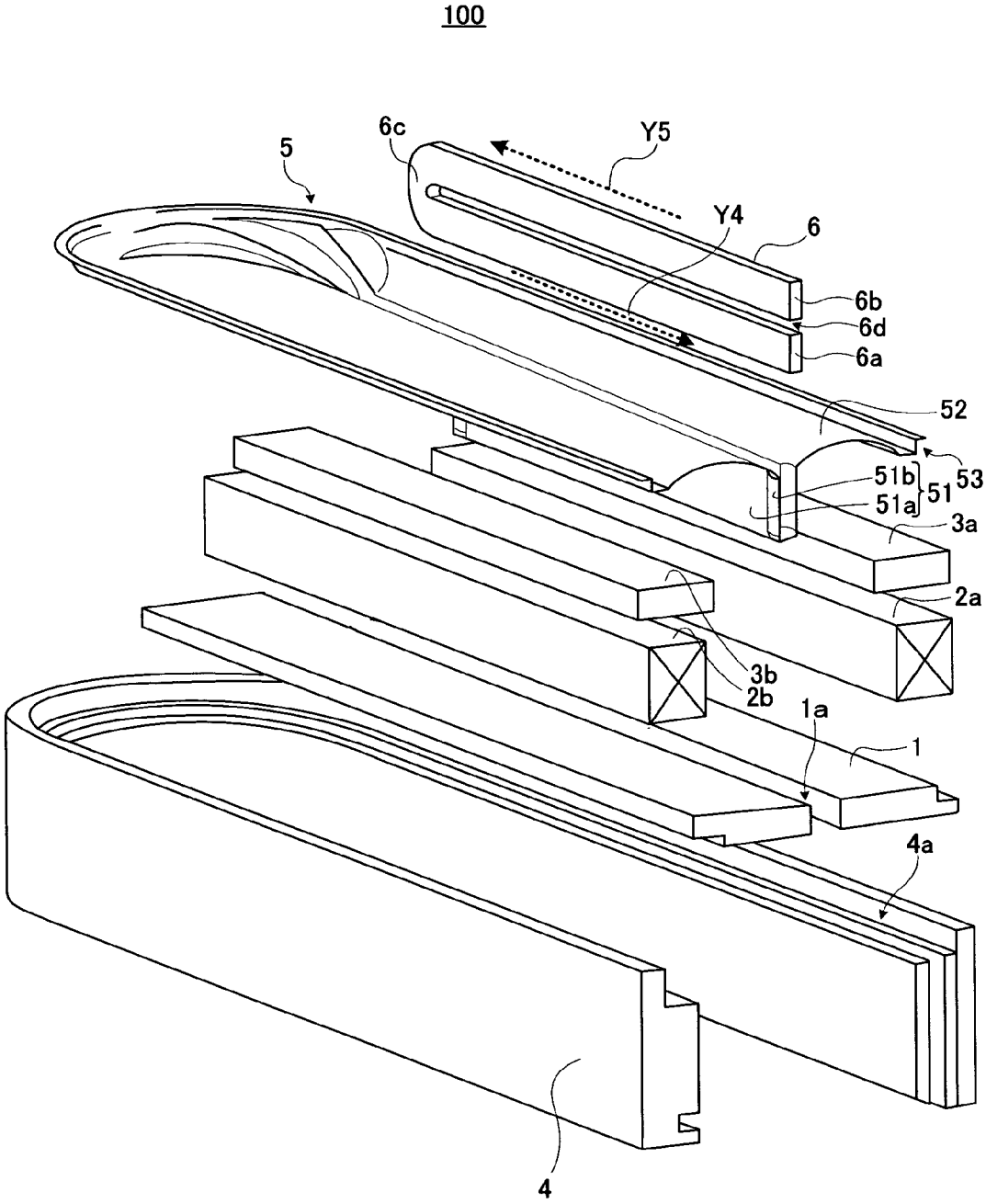
FIG. 2 is a side disassembly perspective view showing the configuration of the speaker device according to this embodiment.
Figure 3:
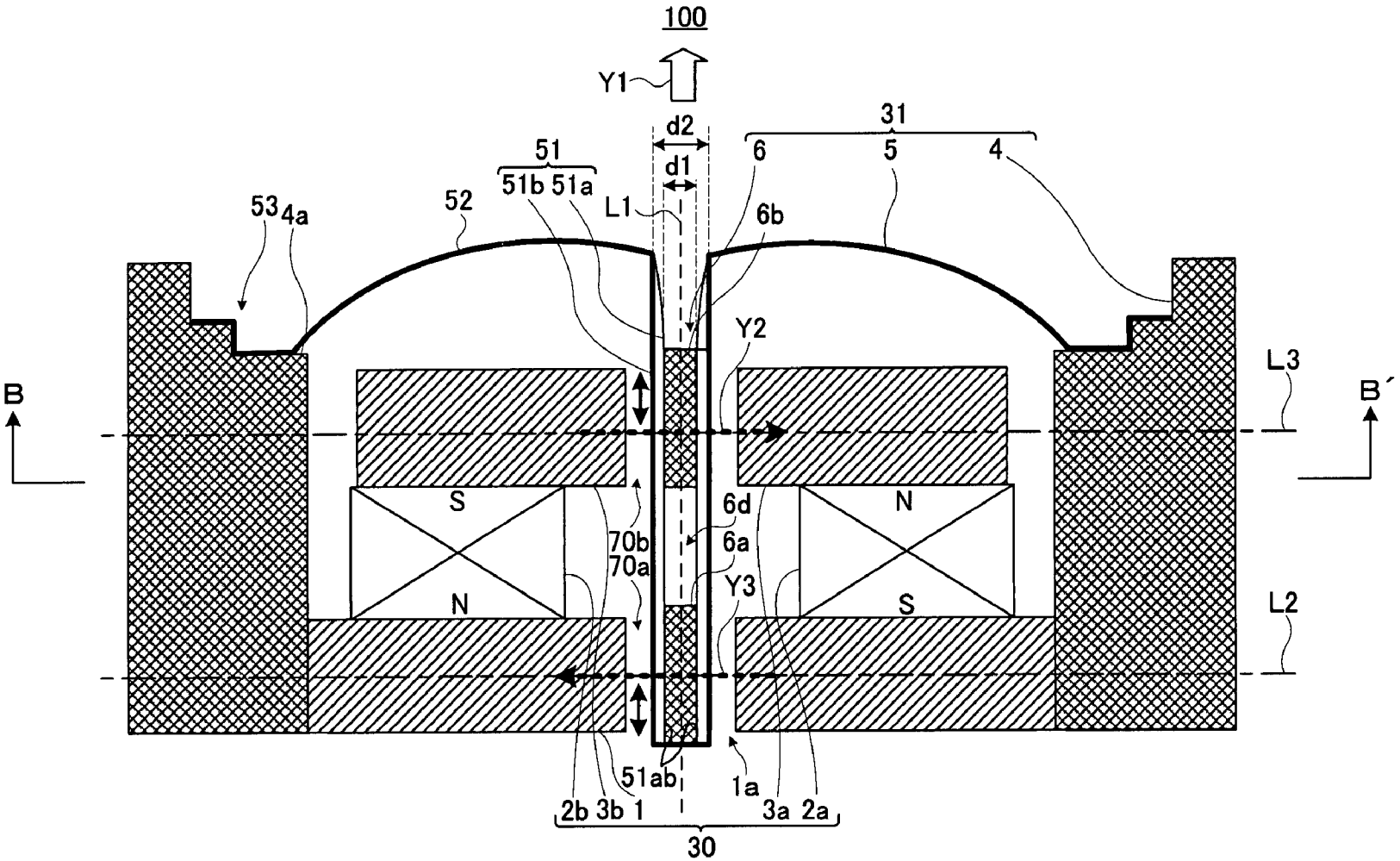
FIG. 3 is a cross-sectional view showing the configuration of the speaker device according to this embodiment.

FIG. 1 shows a plane view of a speaker device 100 according to an embodiment of the present invention when observed from a sound output direction thereof. FIG. 2 shows a disassembly perspective view corresponding to one side of the speaker device 100 taken along a cutting line A-A' passing through its central axis L1 shown in FIG. 1. FIG. 3 is a cross-sectional view of the speaker device 100 taken along the cutting line A-A' passing through the central axis L1, shown in FIG. 1. Hereinafter, a description will be given of the configuration of the speaker device 100 according to the embodiment of the present invention.

The speaker device 100 mainly includes an internal-magnet-type magnetic circuit 30 having a yoke 1, a pair of magnets 2*a* and 2*b* and a pair of plates 3*a* and 3*b*, a frame 4, and a vibration system 31 having a diaphragm 5 and a voice coil 6. Hereinafter, for convenience of explanation, when each of the magnets and/or each of the plates are distinguished, they are individually expressed, like "magnet 2*a*" and "plate 3*a*". Meanwhile, when they are not particularly distinguished, they are expressed as the magnet 2 and the plate 3.

First, a configuration of the magnetic circuit 30 will be explained.

The yoke 1 is formed into a flat plate shape and a rectangular plane shape. In addition, the yoke 1 has an opening 1*a* formed into an elongated shape at a substantially central position in its lateral direction and extending in its longitude direction. The opening 1*a* is formed to be longer than a length of an extending direction (longitude direction) of a voice coil arrangement part 51 of the diaphragm 5 described later. In the opening 1*a*, a magnetic gap 70*a* in which the magnetic flux (magnetic force) of the pair of magnets 2*a* and 2*b* described later is concentrated is formed. In this embodiment, the direction of the magnetic flux in the magnetic gap 70*a* is set to the direction of an arrow Y3. In addition, the opening 1*a* has a function to outwardly output the unnecessary air in the speaker device 100 to the outside thereof at the time of movement of the diagram 5 to the side of the yoke 1. Thereby, it can be prevented that the pressure (i.e., back pressure) in the speaker device 100 becomes high.

Each of the pair of magnets 2*a* and 2*b* is formed into a rectangular parallelepiped shape and an angular pole shape. The relative size and magnetic force of the magnets 2*a* and 2*b* are same. On the yoke 1, the magnets 2*a* and 2*b* are provided at positions opposite to each other with a constant space therebetween. A positional relation of an S-pole and an N-pole of the magnet 2*a* is reverse to the positional relation of an S-pole and an N-pole of the magnet 2*b*. Concretely, the lower surface of the magnet 2*a*, neighboring to the yoke 1, is magnetized to the S-pole, and the upper surface of the magnet 2*a*, neighboring to the plate 3*a*, is magnetized to the N-pole. Correspondently, the lower surface of the magnet 2*b*, neighboring to the yoke 1, is magnetized to the N-pole, and the upper surface of the magnet 2*b*, neighboring to the plate 3*b*, is magnetized to the S-pole. In the present invention, the positional relation of the S-pole and the N-pole of the magnets 2*a* and 2*b* is not limited to the configuration.

Each of the pair of plates 3*a* and 3*b* is formed into a rectangular parallelepiped shape or a flat plate shape. The length in the longitudinal direction of each of the plates 3*a* and 3*b* is set to the substantially same length as that in the longitudinal direction of the magnet 2. The plate 3*a* is mounted on the magnet 2*a*, and the plate 3*b* is mounted on the magnet 2*b*. The plates 3*a* and 3*b* are opposite to each other with a constant space, and a constant gap is formed therebetween. In the gap, the magnetic flux of the pair of magnets 2*a* and 2*b* is concentrated. Namely, in the gap between the plates 3*a* and 3*b*, another magnetic gap 70*b* other than the magnetic gap 70*a* is formed. The direction of the magnetic flux in the magnetic gap 70*b* is set to the direction of an arrow Y2.

As described above, in the magnetic circuit 30, the magnetic force of the pair of magnets 2*a* and 2*b* operates on the magnetic gaps 70*a* and 70*b*, respectively, and the magnitude of the magnetic force generated in the magnetic gaps 70*a* and 70*b* is set to the relatively same magnitude. In addition, the magnetic flux is generated in the direction of the arrow Y3 in the magnetic gap 70*a*, and the magnetic flux is generated in the direction of the arrow Y2 opposite to the arrow Y3 in the magnetic gap 70*b*. The directions of the magnetic flux in the magnetic gaps 70*a* and 70*b* are the relatively opposite directions.

Next, the frame 4 will be explained. The frame 4 is formed into a cylindrical shape. When planarly observed, the frame 4 is formed into an elongated circular shape and an annular (ring) shape. On the upper end surface of the frame 4, a step part 4*a* formed into a step shape, supporting an outer peripheral portion of the diaphragm 5, is provided. The yoke 1 is mounted on the lower end portion of the frame 4, and the frame 4 houses the magnetic circuit 30.

Next, a description will be given of a configuration of the vibration system 31.

The diaphragm 5 is formed into an elongated circular plane shape. The diaphragm 5 includes the voice coil arrangement part 51, having a recessed shape, arranged at the central position in its lateral direction and provided to extend in its longitude direction, a sound output part 52 provided on the outer side of the voice coil arrangement part 51 and having a semicircular cross-section, and a step part 53 provided on the outer side of the sound output part 52 and having a step cross-section. The voice coil 6 is arranged in the voice coil arrangement part 51. The sound output part 52 has a function to output the sound and a function of an edge for absorbing unnecessary vibration at the time of the sound reproduction. Additionally, the length in the lateral direction of the sound output part 52 occupies the major of the length in the lateral direction of the diaphragm 5. Thereby, the high sensitivity, the high efficiency and the low frequency sound can be obtained. The step part 53 becomes engaged with the step part 4*a* of the frame 4. Thereby, in such a state that the voice coil arrangement part 51 is arranged at the substantially central position of the magnetic circuit 30, the diaphragm 5 is supported by the frame 4. The detailed configuration of the diaphragm 5 will be explained later.

The voice coil 6, including a pair of lead wires (not shown) having a plus lead wire and a minus lead wire, is wound to have a plane shape in an elongated circular (ring) state. The plus lead wire is input wiring of an L (or R)-channel signal, and the minus lead wire is input wiring of a ground(GND) signal. Each of the lead wires is electrically connected to each output wiring of an amplifier (not shown). Therefore, a signal and power (hereinafter, simply referred to as "sound current", too) are inputted to the voice coil 6 from the amplifier via each of the lead wires, respectively.

Moreover, the voice coil 6 includes the first parallel part 6*a* extending in one direction, a second parallel part 6*b*, arranged opposite to the first parallel part 6*a* with a constant gap 6*d* and extending in a direction in parallel with the first parallel part 6*a*, and plural connection parts 6*c* connecting each end of the first parallel part 6*a* and each correspondent end of the second parallel part 6*b*. The voice coil 6 is arranged in the voice coil arrangement part 51 of the diaphragm 5.

The length in the longitudinal direction of the first parallel part 6*a* is set to the substantially same length as the length in the longitudinal direction of the voice coil arrangement part 51 of the diaphragm 5. The first parallel part 6*a* and the second parallel part 6*b*, arranged in the voice coil arrangement part 51 of the diaphragm 5, are sandwiched and fixed by side surfaces 51*ab* of a voice coil supporting part 51*a* being the component of the voice coil arrangement part 51. The length in the longitudinal direction of the second parallel part 6*b* is set to the substantially same length as the length in the longitudinal direction of the first parallel part 6*a*. In addition, a constant gap 6*d* is formed between the first parallel part 6*a* and the second parallel part 6*b*, and the second parallel part 6*b* is positioned above the first parallel part 6*a* in the voice coil arrangement part 51 of the diaphragm 5. The first parallel part 6*a* is positioned in the opening la of the yoke 1, i.e., in the magnetic gap 70*a*, and the second parallel part 6*b* is positioned between the plates 3*a* and 3*b*, i.e., in the other magnetic gap 70*b*. That is, the gap 6*d* of the voice coil 6 is set to such a size that the first parallel part 6*a* is positioned in the magnetic gap 70*a* and the second parallel part 6*b* is positioned in the other magnetic gap 70*b*. In this manner, the speaker device 100 employs the so-called 2-magnetic-gap and 2-voice-coil system. In a preferred example, in order to maintain the appropriate vibration state of the voice coil 6 at the time of the sound reproduction, the straight line passing through the center in the thickness direction of the first parallel part 6*a* is preferably positioned on the straight line L2 passing through the center in the thickness direction of the yokel, and the straight line passing through the center in the thickness direction of the second parallel part 6*b* is preferably positioned on the straight line L3 passing through the center in the thickness direction of the pair of plates 3*a* and 3*b*.

In the voice coil 6 having the configuration, since the sound current flows in a circular manner, the direction of the sound current flowing in the first parallel part 6*a* and the direction of the sound current flowing in the second parallel part 6*b* relatively become opposite, as shown in FIG. 2. Namely, in FIG. 2, when the sound current is assumed to flow in the arrow Y4 direction in the first parallel unit 6*a*, the sound current flows in the arrow Y5 direction opposite to the arrow Y4 direction in the second parallel part 6*b*.

In the above-mentioned speaker device 100, the sound current outputted from the amplifier is inputted to the voice coil 6 via each of the lead wires of the voice coil 6. Thereby, the driving force is generated at the first parallel part 6*a* and the second parallel part 6*b* of the voice coil 6 in the two magnetic gaps 70*a* and 70*b*, respectively. The magnitude of the magnetic force generated in the magnetic gap 70*a* and the magnitude of the magnetic force generated in the other magnetic gap 70*b* are set to the same value, as described above. At the same time, since the wind direction of the wiring of the first parallel part 6*a* is relatively opposite to the wind direction of the wiring of the second parallel part 6*b*, the sound current of the same amount flows in the first parallel part 6*a* and the second parallel part 6*b* in the relatively opposite direction. Therefore, the first parallel part 6*a* and the second parallel part 6*b* vibrate with the driving force of the same amount and in the same direction in accordance with Fleming's left-hand rule. Concretely, the first parallel part 6*a* and the second parallel part 6*b* vibrate with the driving force of the same amount in the direction of the central axis L1 of the speaker device 100 and in the same direction, with respect to the straight line L2 passing through the center in the thickness direction of the yoke 1 and with respect to the straight line L3 passing through the center in the thickness direction of the pair of the plates 3*a* and 3*b*, respectively. In this manner, the speaker device 100 outputs the acoustic wave in the direction of the arrow Y1 via the sound output part 52 of the diaphragm 5.

(Configuration of Diaphragm)

Next, a description will be given of the configuration of the diaphragm 5 according to the embodiment of the present invention, with reference to FIGS. 4A and 4B and FIGS. 5A and 5B.

Figure 4A:
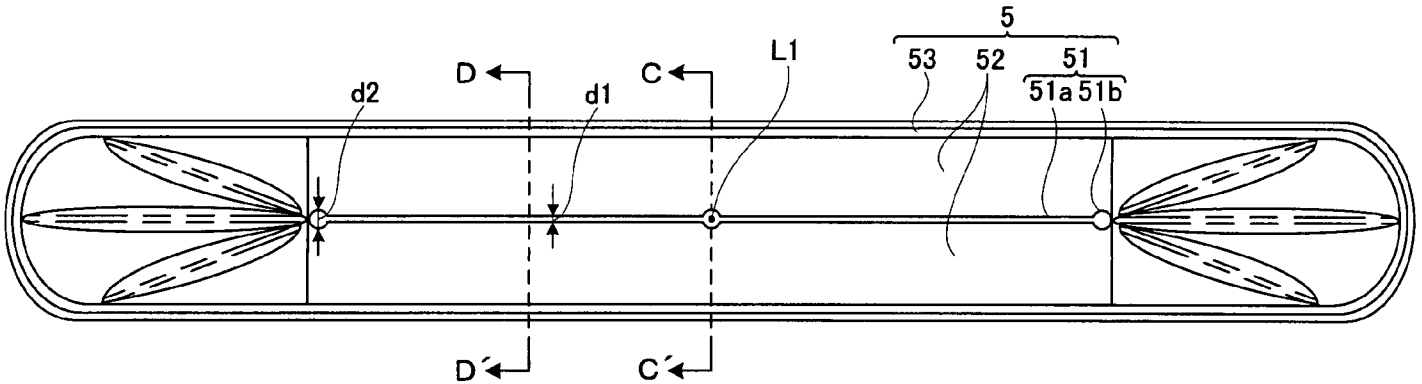
FIGS. 4A and 4B are a plane view and a side view showing a configuration of a diaphragm according to this embodiment of the present invention.
Figure 4B:
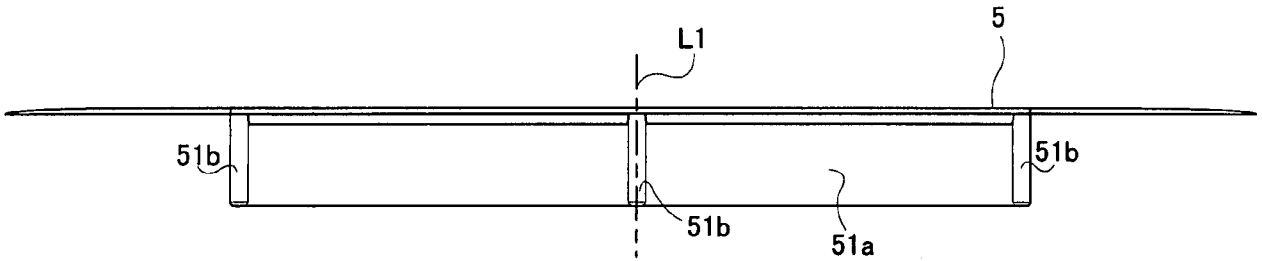
Figure 5B:
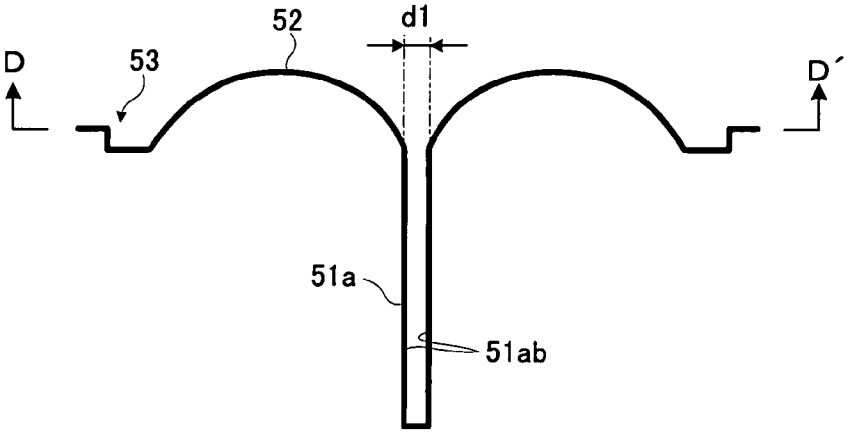
FIGS. 5A and 5B are cross-sectional views showing a configuration of a voice coil arrangement part of the diaphragm according to this embodiment.
Figure 5A:
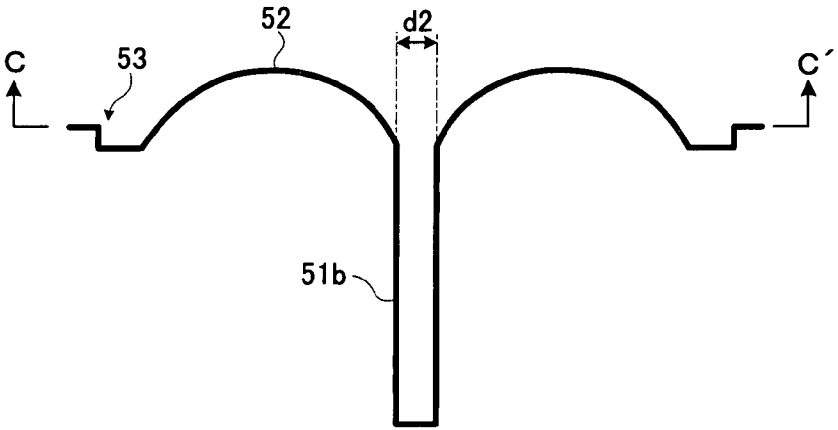

FIG. 4A shows a plane view of the diaphragm 5 when observed from the sound output direction. FIG. 4B shows a side surface view corresponding to the longitude direction of the diaphragm 5. FIG. 5A is a cross-sectional view of the diaphragm 5 taken along the cutting line C-C' shown in FIG. 4A, which particularly corresponds to an expanded part 51*b* being a component of a voice coil arrangement part 51. FIG. 5B is a cross-sectional view of the diaphragm 5 taken along the cutting line D-D' shown in FIG. 4A, which is particularly a cross-sectional view of the voice coil supporting part 51*a* being the component of the voice coil arrangement part 51.

The basic configuration of the diaphragm 5 is described above. Namely, the diaphragm 5 includes the voice coil arrangement part 51 at which the voice coil 6 is arranged, a sound output part 52 provided on the outer side of the voice coil arrangement part 51, and a step part 53 provided on the outer side of the sound output part 52.

The voice coil arrangement part 51 includes the voice coil supporting part 51*a* for supporting the voice coil 6, and the expanded part 51*b* provided at the position continuing into and ting the voice coil supporting part 51*a*.

As shown in FIG. 3, in such a state that the diaphragm 5 is mounted on the frame 4, the voice coil arrangement part 51 extends in the direction in parallel with the direction substantially orthogonal with respect to the directions of arrows Y2 and Y3 being the extending direction of the magnetic flux. The depth of the voice coil arrangement part 51 is set to the substantially same value as the distance from the rear surface of the yoke 1 to the upper surface of the plate 3, for example. The voice coil arrangement part 51 is arranged in the vicinity of the central axis L1 of the speaker device 100, i.e., at the substantially central position in the magnetic circuit 30. Therefore, the vicinity of the lower end portion of the voice coil arrangement part 51 is set to be positioned in the opening 1*a*, and the vicinity of the central part of the voice coil arrangement part 51 is set to be positioned between the pair of magnets 2*a* and 2*b*. Further, the vicinity of the upper end portion of the voice coil arrangement part 51 is set to be positioned between the pair of plates 3*a* and 3*b*. Thereby, the thin and slim speaker device 100 can be realized.

The voice coil supporting part 51*a*, formed into an elongated shape and a sack-like or U-shaped cross-section, has a gap with a constant width d1 in the direction substantially orthogonal with respect to the extending direction thereof, i.e., in the lateral direction of the diaphragm 5, and the gap forms a space formed into a rectangular parallelepiped shape. It is preferred that the gap width d1 is set to as narrow a value as possible in order to enhance the density of the magnetic flux, e.g., substantially 0.2 mm. As shown in FIG. 3, the voice coil 6, sandwiched and fixed by the side surfaces 51*ab* on the inner side of the voice coil supporting part 51*a*, and the voice coil supporting part 51*a* mainly has a function to support the voice coil 6.

The convex part 51*b* has the gap wider than the width d1 of the gap of the voice coil supporting part 51*a*, i.e., the large width gap. The gap of the convex part 51*b* forms a cylindrical space. The width d2(>d1) passing through the center of the gap of the expanded part 51*b* becomes the maximum width in the gap of the expanded part 51*b*. The expanded part 51*b* is provided in the longitude direction of the diaphragm 5, i.e., in the extending direction of the voice coil arrangement part 51 with a constant space. Concretely, the expanded part 51*b* is provided at positions on or near the both ends in the extending direction and at a substantially central position of the voice coil arrangement part 51, respectively. This configuration is only an example. Therefore, in the present invention, the expanded part 51*b* may be provided in the extending direction of the voice coil arrangement part 51 with a constant space. In addition, the number of expanded parts 51*b* may be variable.

Next, operation and effect according to the embodiment of the present invention will be explained, as compared with the comparative example.

First, before explaining the operation and effect of this embodiment, a description will be given of a configuration and a problem of the diaphragm according to the comparative example, with reference to FIGS. 6A and 6B. Hereinafter, the same reference numerals are given to the same components as those of the embodiment, and explanations thereof are simplified or omitted.

Figure 6A:
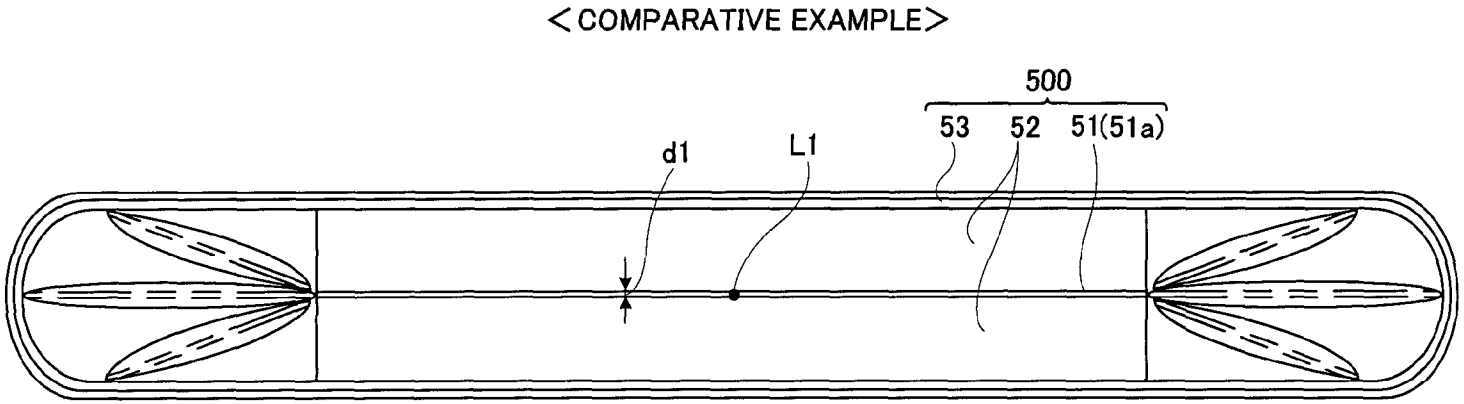
FIGS. 6A and 6B are a plane view and a side view showing a configuration of a speaker device according to a comparative example.
Figure 6B:
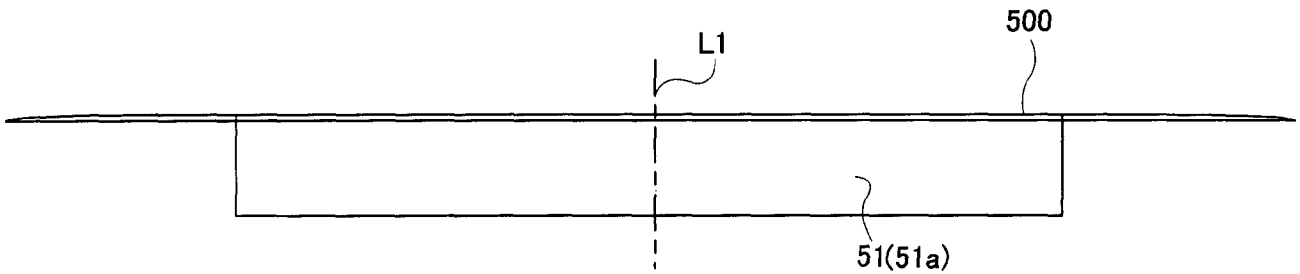

FIG. 6A shows a plane view of a diaphragm 500 according to the comparative example when observed from the sound output direction. FIG. 6B shows a side-surface view corresponding to the longitude direction of the diaphragm 500 according to the comparative example.

When the diaphragm 500 according to the comparative example and the diaphragm 5 according to this embodiment are compared, they are different only in the configuration of the voice coil arrangement part 51.

Concretely, in the diaphragm 500 according to the comparative example, the voice coil arrangement part 51 includes only the part corresponding to the voice coil supporting part 51*a* of this embodiment, and it does not include the part corresponding to the expanded part 51*b* of this embodiment. Namely, the voice coil arrangement part 51 according to the comparative example includes only the voice coil supporting part 51*a* having the gap with the constant width d1, forming the space formed into the rectangular parallelepiped shape. Thus, the diaphragm 500 according to the comparative example has the same cross-section as that of the diaphragm 5 according to the embodiment shown in FIG. 5B.

In the comparative example having the configuration, since the voice coil arrangement part 51 has the elongated configuration and is formed in the linear shape, the structural strength of the part is smaller than that of the circular voice coil form of the diaphragm disclosed in the above-mentioned Reference-1. Hence, at the time of the sound reproduction, the voice coil arrangement part 51 of the diaphragm 500 may bend and warp, or the voice coil arrangement part 51 may roll. Thereby, it may happen that the voice coil arrangement part 51 of the diaphragm 500 and the magnetic circuit 30 contact or collide in the magnetic gap 70*a* and/or 70*b* and the abnormal sound occurs.

Meanwhile, if the part (voice coil form) at which the voice coil is arranged has a circular shape, like the diaphragm disclosed in the above-mentioned Reference-1, the strength thereof can be enhanced, as compared with the comparative example having the linear voice coil arrangement part. Therefore, in the diaphragm 5 according to this embodiment, the plural expanded parts 51*b* having the cylindrical gaps are provided at the voice coil arrangement part 51.

Namely, in this embodiment, since the voice coil arrangement part 51 includes the expanded part 51*b* having the gap (gap forming the cylindrical space) with the width larger than the width d1 of the gap (gap forming the space formed into the rectangular parallelepiped shape) of the voice coil supporting part 51*a* at the position along and connected to the voice coil supporting part 51*a* in the linear shape, the strength of the voice coil arrangement part 51 can be enhanced, as compared with the above-mentioned comparative example. Therefore, if the diaphragm 5 according to this embodiment is applied to the speaker device 100, it becomes unnecessary that the damper is provided for the purpose of the strength reinforcement of the diaphragm 31. Additionally, it can be reduced that, at the time of the sound reproduction, the voice coil arrangement part 51 bends and warps or rolls. Thus, it can be prevented that the voice coil arrangement part 51 and the magnetic circuit 30 contact or collide. Thereby, the occurrence of the abnormal sound can be prevented.

In this embodiment, since the plural expanded parts 51*b* of the voice coil arrangement parts 51 are provided in the extending direction of the voice coil arrangement part 51 with the constant spaces therebetween, at the positions of or near both ends of the extending direction of the voice coil arrangement part 51 and at the substantially central position thereof, respectively, the strength of the entire voice coil arrangement part 51 can be enhanced, and the problem hardly occurs.

Additionally, in this embodiment, the strength of the voice coil arrangement part 51 is sufficiently ensured, as described above. Hence, since the width d1 of the gap of the voice coil supporting part 51*a* at which the voice coil 6 is arranged can be set to as narrow a value as possible, e.g., substantially 0.2 mm, the density of the magnetic flux in the magnetic gaps 70*a* and 70*b* can be enhanced, and the speaker device 100 with the high sensitivity and high efficiency can be obtained. Therefore, it can be preferably used as the speaker of the mobile phone for which the high sensitivity and the high efficiency are recently required, or as the micro speaker for various kinds of electronic equipments.

As compared with the above-mentioned comparative example, it becomes possible to prevent formation failure and damage of the diaphragm forming die at the time of manufacturing of the diaphragm 5, in accordance with this embodiment. This point will be explained with reference to FIGS. 7A to 7C and FIG. 8.

Figure 7C:
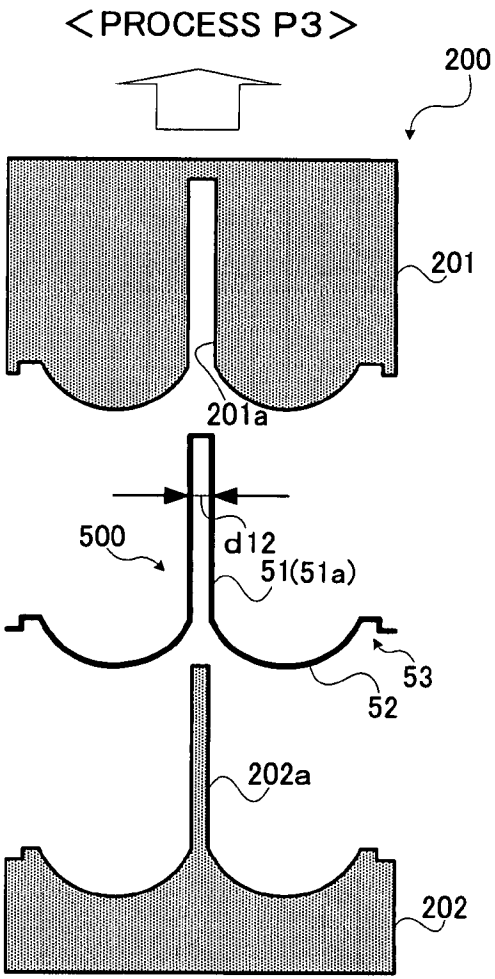
FIGS. 7A to 7C are cross-sectional views corresponding to each manufacturing process of a diaphragm according to the comparative example.
Figure 7B:
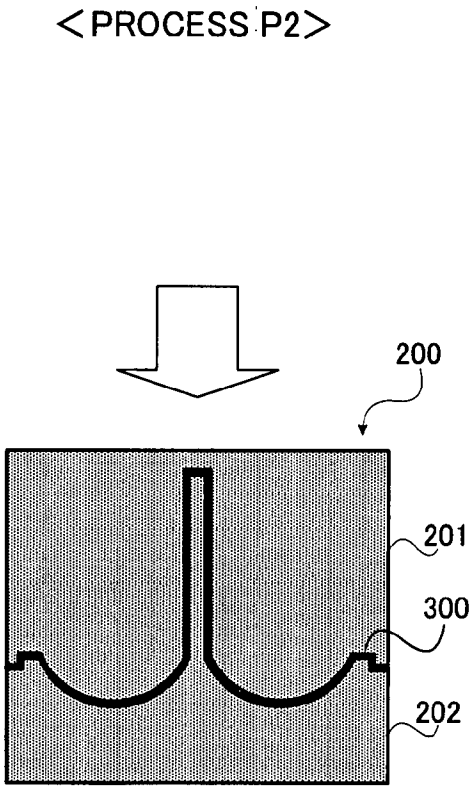
Figure 7A:
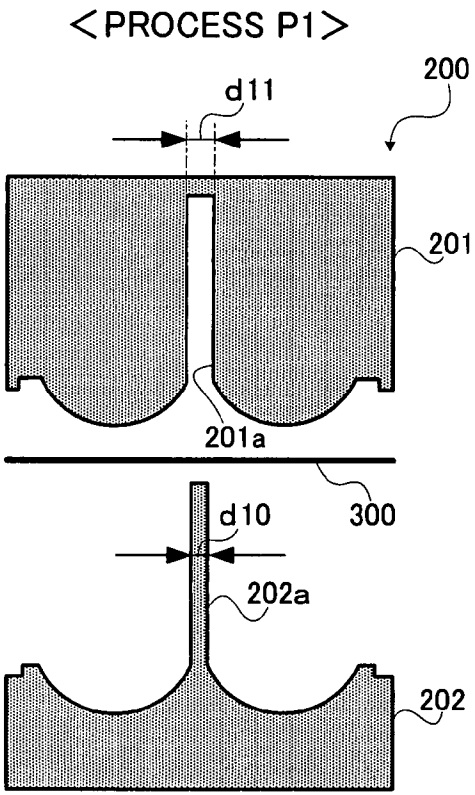

First, a description will be briefly given of the manufacturing method and the problem of the diaphragm 500 according to the comparative example. FIGS. 7A and 7B are cross-sectional views corresponding to each manufacturing process of the diaphragm 500 according to the above-mentioned comparative example.

In the manufacturing method of the diaphragm 500 according to the comparative example, first, a diaphragm forming die 200 having a negative die 201 and a positive die 202, for forming the diaphragm 500, is prepared (Process P1). At this time, in the diaphragm forming die 200, the positive die 202 is arranged on the lower side and the negative die 201 is arranged on the upper side, respectively. A projecting part 202*a* formed in a blade shape is provided in the positive die 202, and a recessed part 201*a* formed into a shape engaged with the projecting part 202*a* is provided in the negative die 201. The projecting part 202*a* and the recessed part 201*a* have a function to form the voice coil arrangement part 51 (see FIG. 7C) having the width d12 of substantially 0.2 mm, preferable as the speaker device for the mobile phone. Thus, the width d10 of the projecting part 202*a* is set to a value smaller than substantially 0.2 mm, and the width d11 of the gap of the recessed part 201*a* is set to a value larger than substantially 0.2 mm, for example. Subsequently, a base material 300 for forming the diaphragm 500 is provided in the diaphragm forming die 200 (Process P1).

Next, by lowering the negative die 201 on the side of the positive die 202, the base material 300 is clamped (pressed) by the negative die 201 and the positive die 202 (Process P2).

Next, by withdrawing the negative die 201 on the upper side, the diaphragm 500 according to the comparative example is manufactured.

In the manufacturing method of the diaphragm 500 according to the comparative example, there may be a problem described below. Namely, in the diaphragm forming die 200, since the width of the projecting part 202*a* having the blade shape, according to the positive die 202 for forming the voice coil arrangement part 51, is set to the extremely thin value smaller than substantially 0.2 mm, if slight stress occurs at the projecting part 202*a* due to the contact between the base material 300 and the projecting part 202*a* at the time of pressing, distortion and slant may occur at the projecting part 202*a*, and the formation failure of the diaphragm 500 and the damage of the diaphragm forming die 200 may occur. Particularly, when a mass production method is employed, the damage of the diaphragm forming die 200 may frequently cause the formation failure of the diaphragm 500. In addition, in the diaphragm forming die 200 according to the comparative example, since the projecting part 202*a* of the positive die 202 is formed in the linear shape and the width thereof is set to the extremely thin value, the strength inevitably becomes low. Therefore, it becomes extremely difficult to manufacture the diaphragm forming die 200 having the positive die 202 without the occurrence of the distortion at the projecting part 202*a*. Moreover, with the low strength of the projecting part 202*a* of the positive die 202, the endurance life thereof becomes short, and hence the life of the diaphragm forming die 200 also becomes short.

When the part (voice coil form) at which the voice coil is arranged has the circular shape, like the diaphragm disclosed in the above Reference-1, since the projecting part of the diaphragm forming die is also formed into the circular shape, the strength of the part becomes high. Thus, even when the pressure is applied to the projecting part formed into the circular shape at the time of the pressing, the projecting part is hardly deformed, as compared with the above-mentioned comparative example. Thereby, the diaphragm forming die is hardly damaged.

Meanwhile, since the voice coil arrangement part 51 of the diaphragm 5 according to this embodiment particularly has the expanded part 51*b* having the circular gap, the diaphragm forming die 400 for forming the diaphragm 5does not have the above-mentioned problem included in the comparative example. Hereinafter, this point will be explained.

Figure 8:
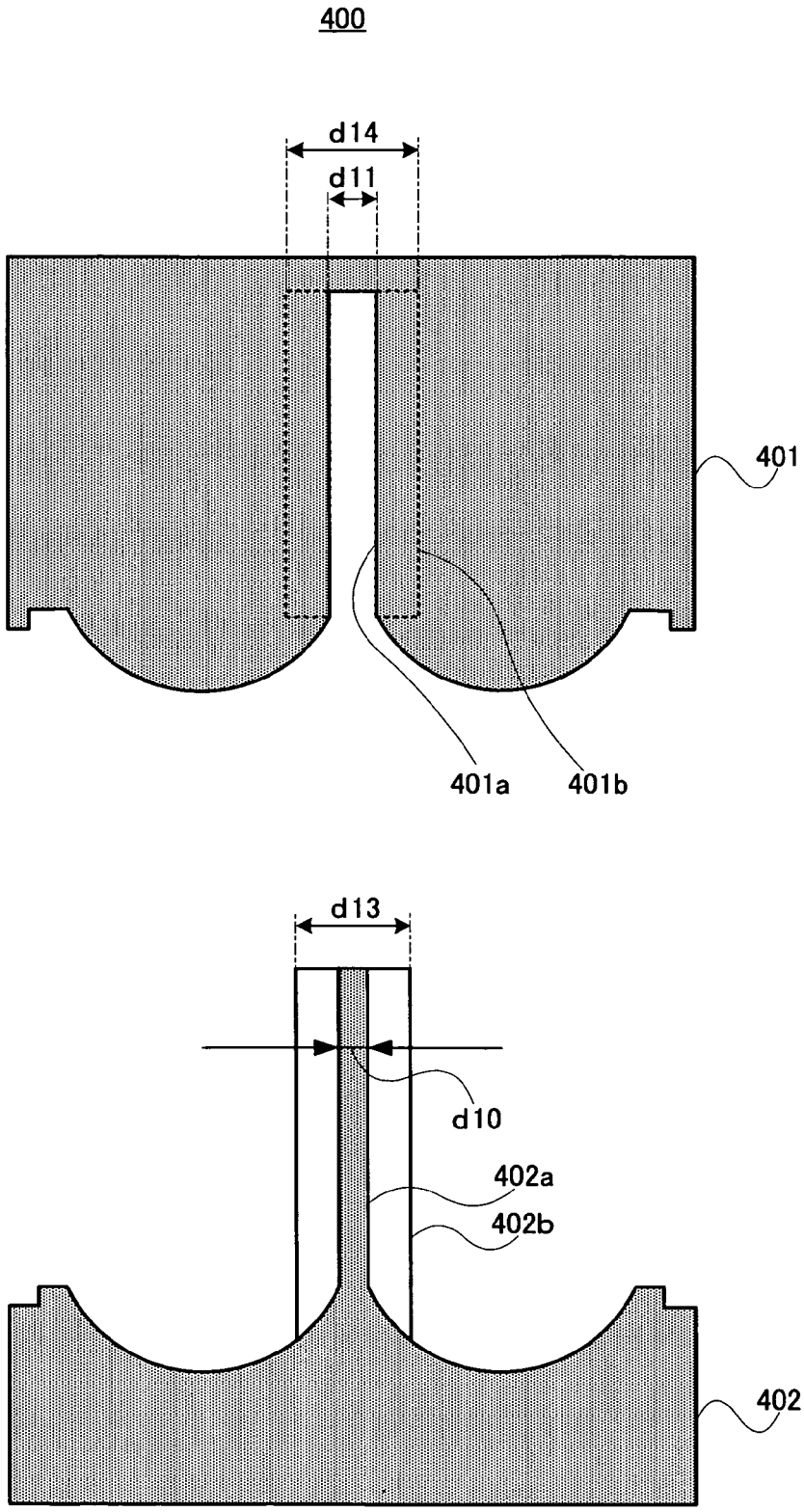
FIG. 8 is a cross-sectional view showing a configuration of a diaphragm forming die according to this embodiment.

FIG. 8 shows a configuration of the diaphragm forming die 400 for forming the diaphragm 5 according to this embodiment, as a cross-sectional view.

The diaphragm forming die 400 according to this embodiment includes a negative die 401 and a positive die 402. The positive die 402 has a projecting part 402*a* for forming the voice coil supporting part 51*a*, formed into a rectangular parallelepiped shape, and a cylindrical projecting part 402*b*, provided at a position along and connected to the projecting part 402*a* and having a cylindrical shape for forming the expanded part 51*b*. The negative die 401 has a recessed part 401*a* having a rectangular parallelepiped gap for forming the voice coil supporting part 51*a* with the projecting part 402*a* of the positive die 402, and a cylindrical recessed part 402*b* having a cylindrical gap for forming the expanded part 51*b* with the cylindrical projecting part 402*b* of the positive die 402, provided at a position continuing into and ting the recessed part 401*a*. The projecting part 402*a* and the recessed part 401*a* have a function to form the voice coil supporting part 51*a* having the width of substantially 0.2 mm, preferable as the speaker device for the mobile phone. The width d10 of the projecting part 402*a* is set to the value smaller than substantially 0.2 mm, and the gap width d11 of the recessed part 401*a* is set to the value larger than substantially 0.2 mm, for example. The width of the cylindrical projecting part 402*b* is set to the value larger than the width d10 of the projecting part 402*a*, and the maximum width passing through the center of the cylindrical projecting part 402*b* is set to d13(>d10), and the width of the cylindrical recessed part 402*b* is set to the value larger than the gap width d11 of the recessed part 401*a*. The maximum width passing through the center of the cylindrical recessed part 402*b* is set to d14 (>d13).

In the diaphragm forming die 400 according to this embodiment, since the positive die 402 includes not only the projecting part 402*a* having the rectangular parallelepiped shape but also the cylindrical projecting part 402*b* having the cylindrical shape, the strength of the projecting part 402*a* and the cylindrical projecting part 402*b* for forming the voice coil arrangement part 51 can be particularly improved. Even when the pressure is applied to those parts at the time of the pressing, the projecting part 402*a* and the cylindrical projecting part 402*b* are hardly deformed. Therefore, the damage of the diaphragm forming die 400 and the formation failure of the diaphragm 5 can be prevented. Thereby, as a side effect, at the time of the manufacturing of the diaphragm forming die 400, the diaphragm forming die 400 including the parts can be easily manufactured without the formation failure of the projecting part 402*a* and the cylindrical projecting part 402*b* of the positive die 402, too. In addition, since the endurance life becomes long with the strength improvement of the projecting part 402*a* and the cylindrical projecting part 402*b* according to the positive die 402 of the diaphragm forming die 400, the life of the diaphragm forming die 400 can be made long.

[Modification]

Figure 9A:
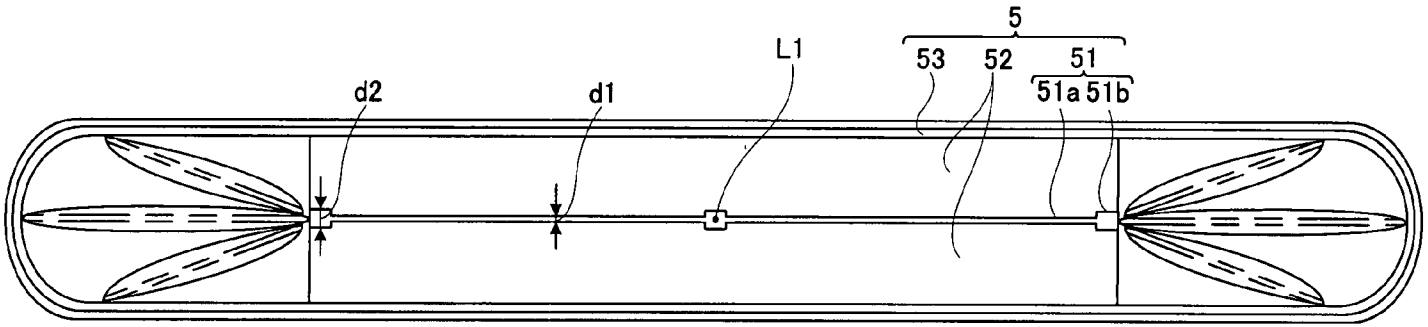
FIGS. 9A and 9B are plane views showing a configuration of a diaphragm according to various kinds of modifications.
Figure 9B:
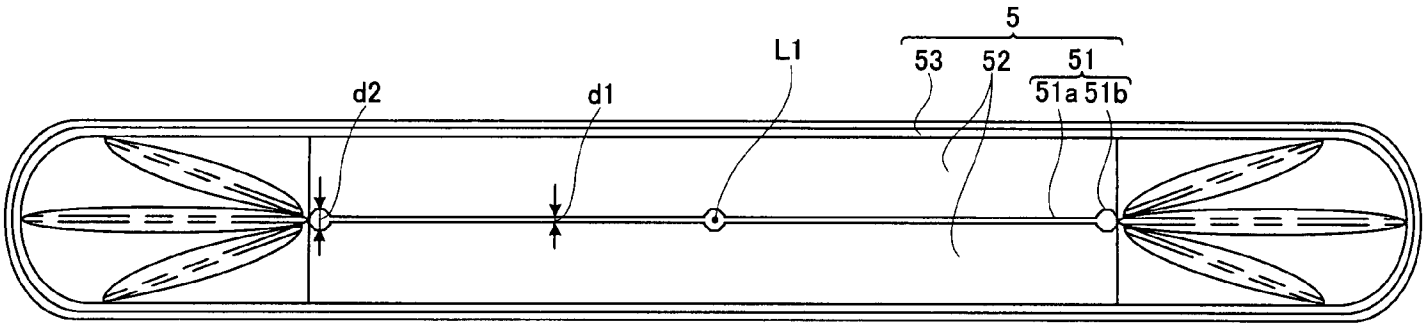

In the above embodiment, the expanded part 51*b* being the component of the voice coil arrangement part 51 is formed to have the cylindrical gap, but the present invention is not limited to this. Namely, in the present invention, the expanded part 51b may be formed to have a gap wider than the gap width d1 of the voice coil supporting part 51*a* having the linear shape, i.e., a gap having a large width, in order obtain to the operation and effect. Therefore, the expanded part 51*b* can be formed to have a gap having various kinds of well-known shapes including the condition. In the present invention, as shown by a plane view of the diaphragm shown in FIG. 9A, the expanded part 51*b* may be formed to have a square-pole gap having the width d2 larger than the gap width d1 of the voice coil supporting part 51*a*, or as shown by a plane view of the diaphragm shown in FIG. 9B, the expanded part 51*b* may be formed to have a multiple-pole gap having the width larger than the gap width d1 of the voice coil supporting part 51a. In the latter case, the maximum width passing through the center of the expanded part 51*b* having a multiple-pole gap can be d2(>d1).

Though the present invention is applied to the speaker device 100 in 2-magnetic-gap and 2-voice-coil system, this configuration is only an example. Therefore, the present invention may be applied to the speaker device 100 having a system including one magnetic gap and one voice coil (i.e., 1-magnetic-gap and 1-voice-coil system).

Additionally, in the present invention, various kinds of deformations are possible within the scope of the invention.

[Application Example to Mobile Phone]

Next, a description will be given of such an example that the speaker device 100 according to the embodiment of the present invention is applied to a receiver part and a call-indicating part of the mobile phone.

Figure 10:
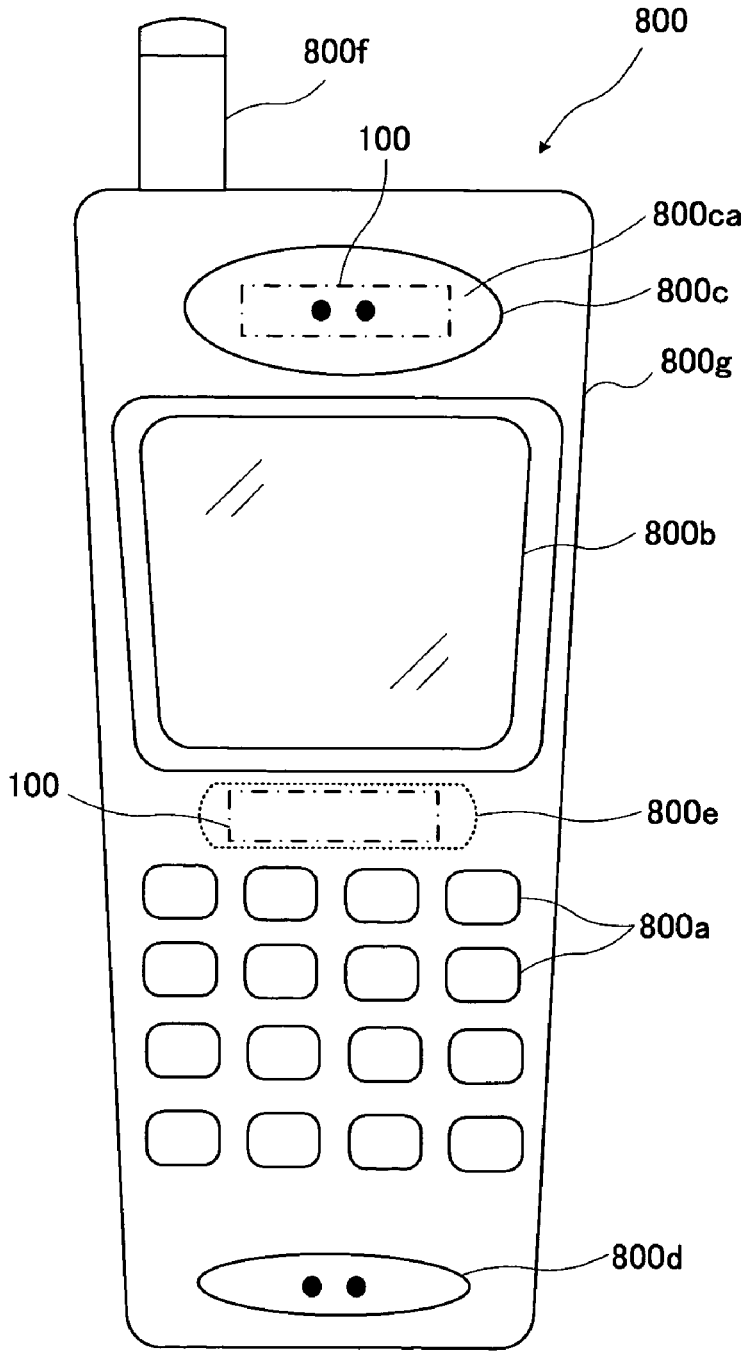
FIG. 10 is a plane view of a mobile phone to which the speaker device of the present invention is applied.

FIG. 10 is a schematic plane view showing a configuration of the mobile phone. A mobile phone 800 shown in the drawing includes plural control bottoms 800*a*, a display part 800*b*, an ear piece 800*c*, a mouth piece 800*d*, all of which are provided on a front side of a case 800*g*, a call-indicating part 800*e* provided on a back side of the case 800*g* and having a function to make a call-receiving alarm sound, and a transmitting and receiving antenna 800*f* provided on one side surface of the case 800*g*. A receiver part 800*ca* is provided in the case 800*g* corresponding to the position of the ear piece 800*c*. In the mobile phone 800 having the above configuration, the speaker device 100 capable of reducing rolling is loaded on the case 800*g* to be provided at positions corresponding to the receiver part 800*ca* and the call-indicating part 800*e*, for example.

The invention may be embodied on other specific forms without departing from the spirit or essential characteristics thereof. The present embodiments therefore to be considered in all respects as illustrative and not restrictive, the scope of the invention being indicated by the appended claims rather than by the foregoing description and all changes which come within the meaning an range of equivalency of the claims are therefore intended to embraced therein.

The entire disclosure of Japanese Patent Application No. 2005-368540 filed on Dec. 21, 2005 including the specification, claims, drawings and summary is incorporated herein by reference in its entirety.

What is claimed is:

1. A diaphragm for a speaker device comprising a voice coil arrangement part in which a voice coil is arranged, wherein the voice coil arrangement part has a substantially rectangular parallelepiped shape with an open upper side, and wherein the voice coil arrangement part comprises:

first lateral walls facing each other with a first distance therebetween;

second lateral walls facing each other with a second distance therebetween, wherein the second distance is greater than the first distance;

a bottom surface perpendicular to the first lateral walls and the second lateral walls; and at least one expanded part in which the first lateral walls face each other with a third distance greater than the first distance therebetween.

2. The diaphragm according to claim 1, wherein the at least one expanded part comprises multiple expanded parts provided with a constant spacing therebetween.

3. The diaphragm according to claim 1, wherein the at least one expanded part comprises first and second expanded parts respectively provided in the vicinity of each of the second lateral walls and a third expanded part substantially equidistant from the first and second expanded parts.

4. The diaphragm according to claim 1, wherein the expanded part forms a space having a prismatic or cylindrical shape.

5. The diaphragm according to claim 1, wherein the voice coil arrangement part is provided at a substantially central position in a lateral direction of the diaphragm.

6. The diaphragm according to claim 1, wherein the first lateral walls sandwich and fix the voice coil.

7. The diaphragm according to claim 1, wherein a sound output part having a hemispherical cross-section and having a function to output an acoustic wave is provided on outer sides of the first lateral walls.

8. A speaker device comprising a diaphragm therefor including a voice coil arrangement part in which a voice coil is arranged, wherein the voice coil arrangement part has a substantially rectangular parallelepiped shape with an open upper side, and wherein the voice coil arrangement part comprises:

first lateral walls facing each other with a first distance therebetween;

second lateral walls facing each other with a second distance therebetween, wherein the second distance is greater than the first distance;

a bottom surface perpendicular to the first lateral walls and the second lateral walls; and at least one expanded part in which the first lateral walls face each other with a third distance greater than the first distance therebetween.

9. The speaker device according to claim 8, further comprising a magnetic circuit including a magnetic gap, wherein the magnetic gap is provided at a substantially central position of the magnetic circuit, and wherein the voice coil arrangement part of the diaphragm is arranged in the magnetic gap.

10. A mobile phone comprising a speaker device including a diaphragm therefor including a voice coil arrangement part in which a voice coil is arranged, wherein the voice coil arrangement part has a substantially rectangular parallelepiped shape with an open upper side, and wherein the voice coil arrangement part comprises:

first lateral walls facing each other with a first distance therebetween;

second lateral walls facing each other with a second distance therebetween, wherein the second distance is greater than the first distance;

a bottom surface perpendicular to the first lateral walls and the second lateral walls; and at least one expanded part in which the first lateral walls face each other with a third distance greater than the first distance therebetween.

* * * * *